US012195152B2

(12) United States Patent
Cao et al.

(10) Patent No.: US 12,195,152 B2
(45) Date of Patent: Jan. 14, 2025

(54) WINGLESS HYDRAULIC EXTRUSION SPIRAL ROTATION AND FORWARD MOVEMENT TYPE INTELLIGENT UNMANNED UNDERWATER VEHICLE

(71) Applicant: Guangdong University of Petrochemical Technology, Maoming (CN)

(72) Inventors: Gengyu Cao, Maoming (CN); Changhao Wang, Maoming (CN); Qun Wang, Maoming (CN)

(73) Assignee: Guangdong University of Petrochemical Technology, Maoming (CN)

( * ) Notice: Subject to any disclaimer, the term of this patent is extended or adjusted under 35 U.S.C. 154(b) by 449 days.

(21) Appl. No.: 17/691,844

(22) Filed: Mar. 10, 2022

(65) Prior Publication Data

US 2023/0286626 A1 Sep. 14, 2023

(51) Int. Cl.

| | |
|---|---|
| ***B63G 8/00*** | (2006.01) |
| ***B63B 79/15*** | (2020.01) |
| ***B63B 79/40*** | (2020.01) |
| ***B63G 8/04*** | (2006.01) |
| ***B63G 8/08*** | (2006.01) |

(52) U.S. Cl.

CPC ..... *B63G 8/001* (2013.01); *B63B 79/15* (2020.01); *B63B 79/40* (2020.01); *B63G 8/04* (2013.01); *B63G 8/08* (2013.01); *B63G 2008/002* (2013.01)

(58) Field of Classification Search

CPC . B63G 8/001; B63G 8/04; B63G 8/08; B63G 2008/002; B63B 79/15; B63B 79/40

See application file for complete search history.

(56) References Cited

U.S. PATENT DOCUMENTS

2010/0235018 A1* 9/2010 Christ ..... G01N 21/952 348/81

FOREIGN PATENT DOCUMENTS

CN 112298502 A * 2/2021
CN 112298505 A * 2/2021

OTHER PUBLICATIONS

Translation of CN 112298505 A (Year: 2021).*

* cited by examiner

*Primary Examiner* — Stephen P Avila
(74) *Attorney, Agent, or Firm* — Procopio, Cory, Hargreaves & Savitch LLP

(57) ABSTRACT

The present disclosure discloses a wingless hydraulic extrusion spiral rotation and forward movement type intelligent unmanned underwater vehicle, including a cabin body and a control module. The cabin body includes a power reaction cabin and a power fuel storage cabin, a power reaction cabin water supply device is fixedly arranged on the cabin body. The power reaction cabin and the power fuel storage cabin are separated by a partition plate. Power fuel in the power fuel storage cabin may enter the power reaction cabin. A tail part of the power reaction cabin is provided with a jet forward propeller. The control module is fixed on the cabin body. At least two jet rotation propellers are arranged on the cabin body. The jet rotation propeller includes a main propelling pipe, an auxiliary propelling pipe, and a jet magnification ring. The jet magnification ring includes an outer ring and an inner ring.

8 Claims, 4 Drawing Sheets

WINGLESS HYDRAULIC EXTRUSION SPIRAL ROTATION AND FORWARD MOVEMENT TYPE INTELLIGENT UNMANNED UNDERWATER VEHICLE

TECHNICAL FIELD

The present disclosure relates to the technical field of underwater robots, in particular to a wingless hydraulic extrusion spiral rotation and forward movement type intelligent unmanned underwater vehicle.

BACKGROUND ART

The underwater world contains a lot of energy and rich resources, which play an important role in human understanding of the world and social development. As an important means of exploring the underwater world, an intelligent underwater vehicle is an underwater vehicle that can be carried by an aircraft, a surface ship, a submarine, etc. The intelligent underwater vehicle has main functions of searching, rescuing and autonomous ocean exploration, and can also carry a detector, an underwater prefabricated weapon, a mine, etc., can independently complete a series of tasks. Autonomous underwater vehicles are currently widely valued by countries around the world, and are effective tools for human beings in the modern society to know the ocean and develop and utilize the ocean.

At present, most intelligent underwater vehicles use lead-acid batteries, alkaline batteries or lithium batteries for energy supply. Once the battery fails, the vehicle will not be able to operate normally. In addition, when a submersible executes an underwater task at high mobility, it often causes a decrease in the endurance, reduces the underwater working time, and affects the performance index of the submersible. In order to improve the stability of the autonomous underwater vehicle, implement the transformation of ability, achieve the purpose of autonomously generating power and operating independently, ensure normal operation, and achieve an effect of saving energy, it is necessary to design a novel intelligent unmanned autonomous underwater vehicle.

SUMMARY

The technical problem to be solved in the present disclosure is to provide a wingless hydraulic extrusion spiral rotation and forward movement type intelligent unmanned underwater vehicle. The unmanned underwater vehicle can autonomously provide power for navigation, which greatly saves the energy, thereby the unmanned underwater vehicle can undertake tasks such as maritime patrol and reconnaissance and maritime relay communication.

In order to solve the above technical problems, the present disclosure adopts the following technical solutions:

A wingless hydraulic extrusion spiral rotation and forward movement type intelligent unmanned underwater vehicle includes a cabin body and a control module.

The cabin body includes a power reaction cabin and a power fuel storage cabin, and a power reaction cabin water supply device is fixedly arranged on the cabin body.

The power reaction cabin and the power fuel storage cabin are separated by a partition plate. Power fuel in the power fuel storage cabin may enter the power reaction cabin. A tail part of the power reaction cabin is provided with a jet forward propeller.

The control module is fixed on the cabin body.

At least two jet rotation propellers are arranged on the cabin body. A center axis of an outlet of each jet propeller and a center axis of the cabin body form an included angle of 10-40 degrees; the jet propeller includes a main propelling pipe, an auxiliary propelling pipe, and a jet magnification ring; and the jet magnification ring includes an outer ring and an inner ring.

In one implementation mode, a tail end of the main propelling pipe is provided with at least three auxiliary propelling pipes uniformly arranged on a circumference in an outwards diffusion manner, and an outlet of each auxiliary propelling pipe is led into the jet magnification ring.

In one implementation mode, the outlet of each auxiliary propelling pipe is bent, so that the direction of the outlet deviates from the center axis of the auxiliary propelling pipe by 40-90 degrees.

In one implementation mode, the power fuel storage cabin includes a power fuel extrusion hood and a power fuel outlet valve; a tail end of the power fuel extrusion hood is lined within the power fuel storage cabin and is freely slidable back and forth and sealable; the power fuel outlet valve is located at the tail part of the power fuel storage cabin, passes through the partition plate between the power reaction cabin and the power fuel storage cabin, and extends into the power reaction cabin; and power fuel is arranged in the power fuel storage cabin.

In one implementation mode, the power fuel outlet valve is a check valve.

In one implementation mode, the power fuel is a substance that can react with water and produce gas and/or energy.

In one implementation mode, the power fuel is gelatinous liquid formed by sodium metal particles or sodium metal powder and kerosene or other nonreactive oil substances. The power fuel in the power fuel storage cabin adopts the gelatinous liquid formed by sodium metal particles or sodium metal powder and kerosene or other nonreactive oil substances; the sodium metal particles or sodium metal powder is uniformly suspended in the above medium and are sprayed into the reaction cabin through the power fuel outlet valve at the rear part of the power fuel storage cabin to react with water to produce gas and/or energy that is used as movement energy of the underwater vehicle.

In one implementation mode, the power reaction cabin water supply device includes a water supply pump, a filter, and a water inlet check valve; the water supply pump is mounted in the power reaction cabin water supply device; the filter is mounted at the lower part of the power reaction cabin water supply device; and the water inlet check valve is used for connecting the power reaction cabin water supply device with the reaction cabin.

In one implementation mode, the control module includes an environmental sensor, a depth sensor, a temperature sensor, a controller, a main control board, an energy management board, a radio station component, a positioning module, an attitude sensor module, an electronic compass module, and a battery; and the environmental sensor, the depth sensor, the temperature sensor, the controller, the main control board, the energy management board, the radio station component, the positioning module, the attitude sensor module, the electronic compass module, and the battery are all arranged in the control module subassembly.

Any range recited herein includes any sub-range composed of end values and any numerical value between the end values and the end values or any numerical value between the end values.

Unless otherwise specified, each raw material in the present disclosure can be commercially obtained. Equipment used in the present disclosure can be performed with conventional equipment in the art or with reference to the prior art in the art.

Compared with the prior art, the present disclosure has the following beneficial effects:

The unmanned underwater vehicle can autonomously provide power to achieve spiral rotation type forward movement, which greatly saves the energy, thereby the unmanned underwater vehicle can undertake tasks such as maritime patrol and reconnaissance and maritime relay communication.

BRIEF DESCRIPTION OF THE DRAWINGS

The specific implementation modes of the present disclosure are further described below in detail in combination with the accompanying drawings.

DETAILED DESCRIPTION OF THE EMBODIMENTS

Figure 1:
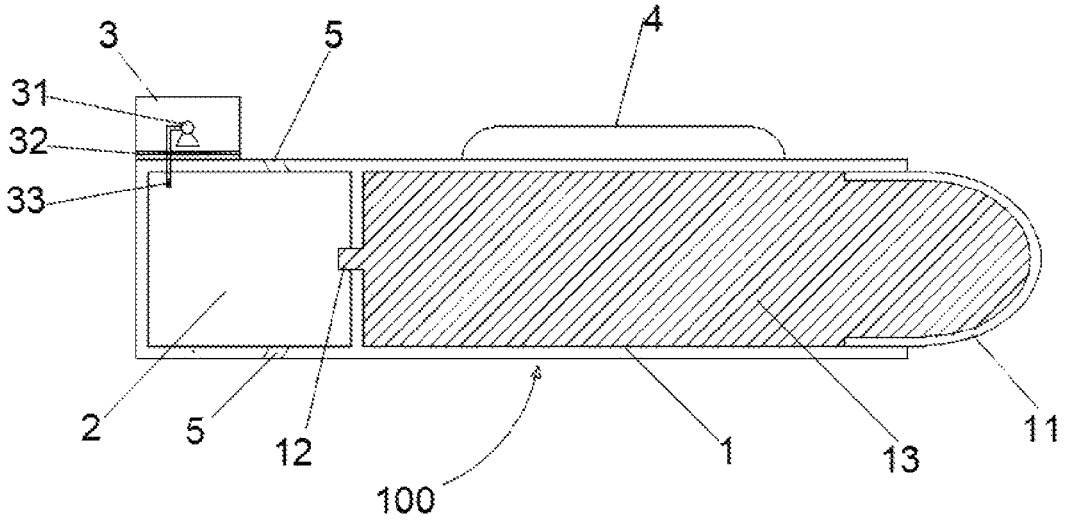
FIG. 1 is a schematic sectional diagram of an intelligent unmanned underwater vehicle in the present disclosure.

In order to illustrate the present disclosure more clearly, the present disclosure will be further described below with reference to the preferred embodiments. Those skilled in the art should understand that the content specifically described below is illustrative rather than restrictive, and should not limit the protection scope of the present disclosure.

It should be noted that when an element is referred to as being "fixed to" or "disposed on" another element, it can be directly on the other element or indirectly on the other element. When an element is referred to as being "connected to" another element, it can be directly connected to the other element or indirectly connected to the other element.

It should be understood that orientations or positional relationships indicated by the terms "length", "width", "upper", "lower", "front", "rear", "left", "right", "vertical", "horizontal", "top", "bottom", "inside", "outside", etc. are based on the orientations or positional relationships shown in the accompanying drawings, which are only for the convenience of describing the present disclosure and simplifying the description, instead of indicating or implying that devices or elements indicated must have particular orientations, and be constructed and operated in the particular orientations, so that these terms are not construed as limiting the present disclosure.

In addition, the terms "first" and "second" are used for descriptive purposes only and are not to be understood to indicate or imply relative importance or to imply the number of indicated technical features. Therefore, features defined by "first" and "second" can explicitly instruct or impliedly include one or more features. In the description of the present disclosure, unless expressly specified otherwise, the meaning of the "plurality" is two or more than two.

Referring to FIG. 1 to FIG. 4, as one aspect of the present disclosure:

A wingless hydraulic extrusion spiral rotation and forward movement type intelligent unmanned underwater vehicle includes a cabin body 100 and a control module 4. The cabin body 100 includes a power fuel storage cabin 1 and a power reaction cabin 2. A power reaction cabin water supply device 3 is fixedly arranged on the cabin body 100.

The power reaction cabin 2 and the power fuel storage cabin 1 are separated by a partition plate. The power reaction cabin 2 is located on the left side of the power fuel storage cabin 1. Power fuel in the power fuel storage cabin 1 may enter the power reaction cabin 2. A tail part of the power reaction cabin is provided with a jet forward propeller 21.

The control module 4 is fixed on the power fuel storage cabin 1.

The power reaction cabin water supply device 3 is fixed on the upper part of the power reaction cabin 2.

At least two jet rotation propellers 5 are arranged on the cabin body 100. A center axis of an outlet of each jet rotation propeller 5 and a center axis of the cabin body form an included angle of 10-40 degrees; the jet rotation propeller 5 includes a main propelling pipe 51, an auxiliary propelling pipe 52, and a jet magnification ring 53; and the jet magnification ring 53 includes an outer ring 531 and an inner ring 532, referring to FIG. 5 and FIG. 6.

In the present disclosure, the center axis of an outlet of each jet rotation propeller 5 and the center axis of the cabin body form an included angle of 10-40 degrees, so that when jetted water applies a counter-acting force to the cabin body, the cabin body rotates step by step, and the vehicle can keep stable rotation and forward movement under the impact of seawater.

Figure 5:
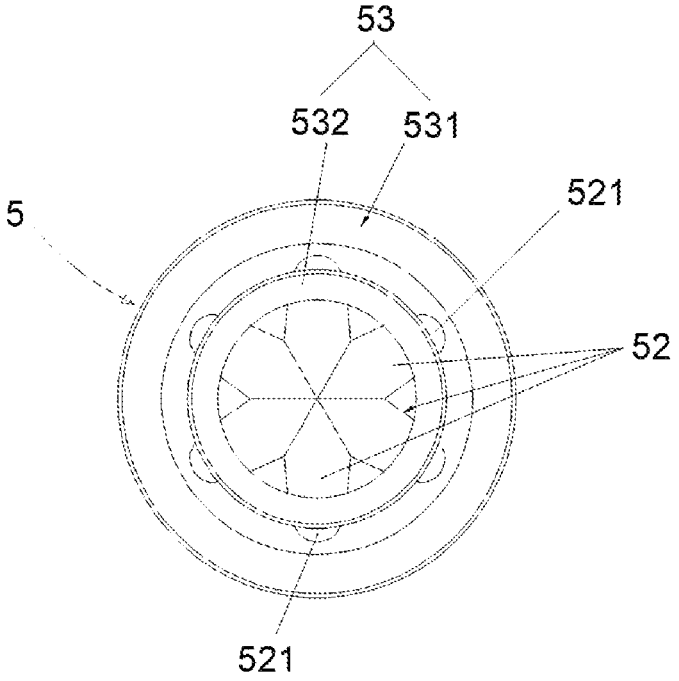
FIG. 5 is a front view of a jet propeller in the present disclosure.
Figure 6:
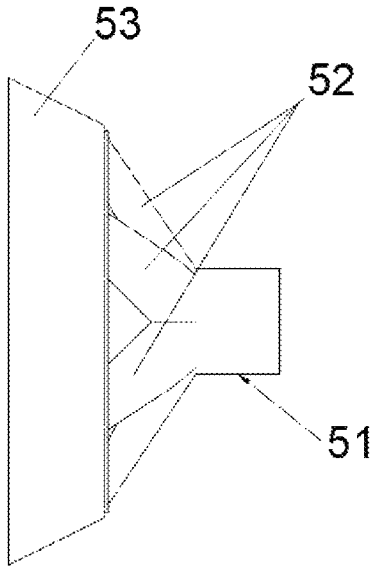
FIG. 6 is a side view of a jet propeller in the present disclosure.

In some embodiments, referring to FIG. 5 and FIG. 6, a tail end of the main propelling pipe 51 is provided with six auxiliary propelling pipes 52 uniformly arranged on a circumference in an outwards diffusion manner, and an outlet 521 of each auxiliary propelling pipe 52 is led into the jet magnification ring 53.

Figure 7:
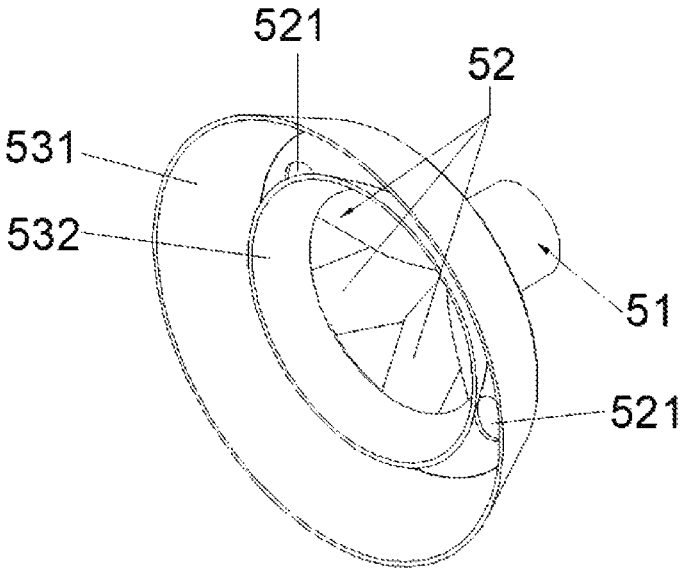
FIG. 7 is a three-dimensional diagram of a jet propeller in the present disclosure.

Referring to FIG. 7, the outlet 521 of each auxiliary propelling pipe 52 is bent, so that the direction of the outlet 521 deviates from the center axis of the auxiliary propelling pipe 52 by 40-90 degrees. When the water flow jetted from this bent outlet applies the counter-reacting force to the cabin body, it is more conductive to gradual rotation of the cabin body, so that the vehicle can keep stable rotation and forward movement under the impact of the seawater.

Figure 2:
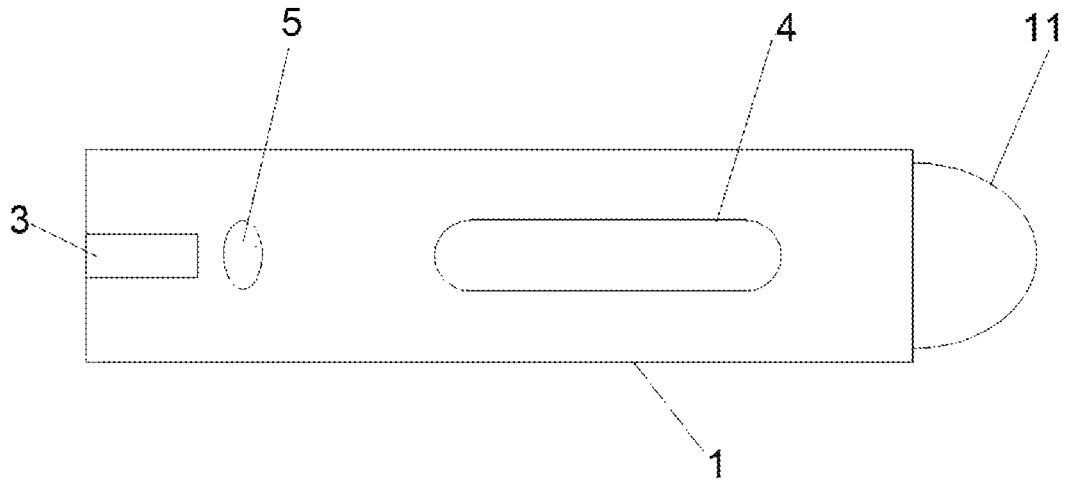
FIG. 2 is a schematic top view of the intelligent unmanned underwater vehicle in the present disclosure.
Figure 3:
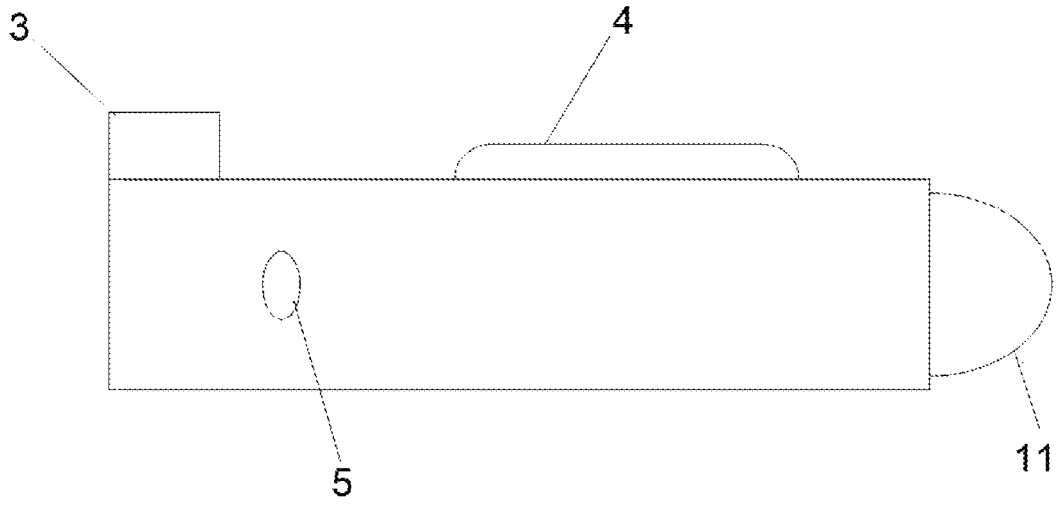
FIG. 3 is a schematic side view of the intelligent unmanned underwater vehicle in the present disclosure.
Figure 4:
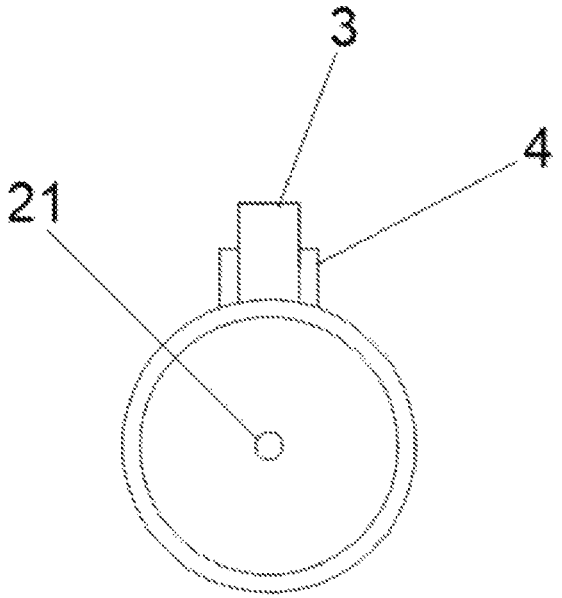
FIG. 4 is a schematic side view of the intelligent unmanned underwater vehicle in the present disclosure.

In some embodiments, referring to FIG. 1 to FIG. 3, the power fuel storage cabin 1 includes a power fuel extrusion hood 11 and a power fuel outlet valve 12; a tail end of the power fuel extrusion hood 11 is lined within the power fuel storage cabin 1 and is freely slidable back and forth and sealable; the power fuel outlet valve 12 is located at the tail part of the power fuel storage cabin 1, passes through the partition plate between the power reaction cabin 2 and the power fuel storage cabin 1, and extends into the power reaction cabin 2; and power fuel 13 is arranged in the power fuel storage cabin 1. In the forward movement process of the vehicle, the power fuel extrusion hood 11 backwards compresses the power fuel 13 in the power fuel storage cabin 1 under an extrusion force of water in the front, so that the power fuel 13 can enter the power reaction cabin subassembly at the back through the power fuel outlet valve 12.

In some preferable embodiments, the power fuel outlet valve 12 is a check valve.

In some embodiments, referring to FIG. 1, the power fuel 13 is a substance that can react with water and produce gas and/or energy.

In some preferable embodiments, the power fuel is gelatinous liquid formed by sodium metal particles or sodium metal powder and kerosene or other nonreactive oil substances. The power fuel in the power fuel storage cabin adopts the gelatinous liquid formed by sodium metal particles or sodium metal powder and kerosene or other nonreactive oil substances; the sodium metal particles or sodium metal powder is uniformly suspended in the above medium and are sprayed into the reaction cabin through the power fuel outlet valve at the rear part of the power fuel storage cabin to react with water to produce gas and/or energy that is used as movement energy of the underwater vehicle.

The power fuel in the power fuel storage cabin 1 may enter the power reaction cabin 2 in one way and is mixed with the water in the power reaction cabin for reaction. Gas is released, and pressure is generated, so that a gas-water mixed solution is jetted to the outside through the jet rotation propeller 5, so as to push the vehicle to rotatably forward. By means of adjusting the direction and jet pressure of the jet rotation propeller 5, acceleration, deceleration, floating and sinking of the vehicle can be adjusted.

In some embodiments, referring to FIG. 1, the power reaction cabin water supply device 3 includes a water supply pump 31, a filter 32, and a water inlet check valve 33; the water supply pump 31 is mounted in the power reaction cabin water supply device 3; the filter 32 is mounted at the lower part of the power reaction cabin water supply device 3; and the water inlet check valve 33 is used for connecting the power reaction cabin water supply device 3 with the power reaction cabin 2. Therefore, filtered water can enter the power reaction cabin 2 in one way.

In some embodiments, the control module 4 includes an environmental sensor, a depth sensor, a temperature sensor, a controller, a main control board, an energy management board, a radio station component, a positioning module, an attitude sensor module, an electronic compass module, and a lithium battery pack; and the environmental sensor, the depth sensor, the temperature sensor, the controller, the main control board, the energy management board, the radio station component, the positioning module, the attitude sensor module, the electronic compass module, and the lithium battery pack are all arranged in the control module subassembly.

The working principle of the wingless hydraulic extrusion spiral rotation and forward movement type intelligent unmanned underwater vehicle of the present disclosure is as follows:

Referring to FIG. 1 to FIG. 7, the unmanned underwater vehicle of the present disclosure has no initial power and can be loaded on a surface ship, a submarine, an airplane, and other systems. During use, the unmanned underwater vehicle is launched to a predetermined position. An instruction is received through the environmental sensor in the control module 4. The check valve 12 between the power fuel storage cabin 1 and the power reaction cabin 2 is opened. The power fuel, that is, the gelatinous liquid formed by the sodium metal particles or sodium metal powder and kerosene or other nonreactive oil substances, is arranged in the power fuel storage cabin 1. Since the power fuel extrusion hood 11 in the power fuel storage cabin 1 continuously impacts water, the power fuel inside the power fuel storage cabin is pressed by the pressure inside the power fuel storage cabin 1 into the power reaction cabin 2 through the check valve 12. The inside of the power reaction cabin 2 is communicated with the water inlet check valve 303 through the water supply pump 301 to cause water to enter the reaction cabin 2. The power fuel entering from the power fuel storage cabin 1 is mixed with the water for reaction. Gas is released, and a high pressure is generated. At this time, the jet forward propeller 21 and the jet rotation propeller 5 are turned on, so that the gas-water mixed solution is jetted to the outside through the jet forward propeller 21 and the jet rotation propeller 5 to push the underwater vehicle to move forwards and rotate. As the underwater vehicle spirally rotates and forwards moves, the power fuel extrusion hood 11 continues to impact water, and a pressure is continued to be generated inside the power fuel storage cabin 1 to continuously extrude the internal power fuel into the power reaction cabin 2. The power fuel continuously reacts with the water inside the power reaction cabin 2 to continuously produce gas and water mixtures which are jetted through the jet propeller 5. This circulating process enables the underwater vehicle to obtain power for continuously forwards moving without an external force. Turning off the jet forward propeller 21 and the jet rotation propeller 5 can decelerate the vehicle. The control module 4 adjusts a state of the underwater vehicle, speeds of forward movement, backward movement, up-and-down floating and spiral rotation, and an information transmission function by means of the environmental sensor, the depth sensor, the temperature sensor, the controller, the main control board, the energy management board, the radio station component, the Beidou/GPS (Global Positioning System) positioning module, the attitude sensor module, the electronic compass module, and the lithium battery pack.

The above-mentioned process is repeated, so that the present disclosure can autonomously provide power for navigation, which greatly saves the energy, thereby the unmanned underwater vehicle can undertake tasks such as maritime patrol and reconnaissance and maritime relay communication.

The present disclosure combines the traditional concept with the self-sufficient design mode, so that the underwater vehicle has two modes, that is, it can be controlled manually or can generate kinetic energy independently for running. The underwater navigation can be performed like an unmanned surface ship, such as maritime patrol and reconnaissance, maritime relay communication, marine environment survey, polluted water monitoring, and other tasks. The underwater vehicle has strong environmental adaptability, better maneuverability and higher safety.

Apparently, the above-mentioned embodiments of the present disclosure are merely examples for illustrating the present disclosure, and are not intended to limit the implementation modes of the present disclosure. Those of ordinary skill in the art can further make other changes or modifications in different forms on the basis of the above-mentioned descriptions. It is not possible to give an exhaustive list of all implementation modes here. All obvious changes or modifications derived from the technical solutions of the present disclosure still fall within the protection scope of the present disclosure.

What is claimed is:

1. A wingless hydraulic extrusion spiral rotation and forward movement type intelligent unmanned underwater vehicle, comprising a cabin body and a control module, wherein the cabin body comprises a power reaction cabin and a power fuel storage cabin, and a power reaction cabin water supply device is fixedly arranged on the cabin body;

the power reaction cabin and the power fuel storage cabin are separated by a partition plate; power fuel in the power fuel storage cabin may enter the power reaction cabin; a tail part of the power reaction cabin is provided with a jet forward propeller;

the control module is fixed on the cabin body;

at least two jet rotation propellers are arranged on the cabin body; a center axis of an outlet of each jet propeller and a center axis of the cabin body form an included angle of 10-40 degrees; the jet propeller comprises a main propelling pipe, an auxiliary propelling pipe, and a jet magnification ring; and the jet magnification ring includes an outer ring and an inner ring;

the power fuel storage cabin comprises a power fuel extrusion hood and a power fuel outlet valve;

a tail end of the power fuel extrusion hood is lined within the power fuel storage cabin and is freely slidable back and forth and sealable, the power fuel extrusion hood is opened toward the power fuel outlet valve and is able to contain the power fuel; and the power fuel outlet valve is located at the tail part of the power fuel storage cabin, passes through the partition plate between the power reaction cabin and the power fuel storage cabin, and extends into the power reaction cabin; and power fuel is arranged in the power fuel storage cabin.

2. The wingless hydraulic extrusion spiral rotation and forward movement type intelligent unmanned underwater vehicle according to claim 1, wherein a tail end of the main propelling pipe is provided with at least three auxiliary propelling pipes uniformly arranged on a circumference in an outwards diffusion manner, and an outlet of each auxiliary propelling pipe is led into the jet magnification ring.

3. The wingless hydraulic extrusion spiral rotation and forward movement type intelligent unmanned underwater vehicle according to claim 2, wherein the outlet of each auxiliary propelling pipe is bent, so that a direction of the outlet deviates from the center axis of the auxiliary propelling pipe by 40-90 degrees.

4. The wingless hydraulic extrusion spiral rotation and forward movement type intelligent unmanned underwater vehicle according to claim 1, wherein the power fuel outlet valve is a check valve.

5. The wingless hydraulic extrusion spiral rotation and forward movement type intelligent unmanned underwater vehicle according to claim 1, wherein the power fuel is a substance that may react with water and produce gas and/or energy.

6. The wingless hydraulic extrusion spiral rotation and forward movement type intelligent unmanned underwater vehicle according to claim 5, wherein the power fuel is gelatinous liquid formed by sodium metal particles or sodium metal powder and kerosene or other nonreactive oil substances.

7. The wingless hydraulic extrusion spiral rotation and forward movement type intelligent unmanned underwater vehicle according to claim 1, wherein a power reaction cabin water supply device comprises a water supply pump, a filter, and a water inlet check valve; the water supply pump is mounted in the power reaction cabin water supply device; the filter is mounted at a lower part of the power reaction cabin water supply device; and the water inlet check valve is used for connecting the power reaction cabin water supply device with the reaction cabin.

8. The wingless hydraulic extrusion spiral rotation and forward movement type intelligent unmanned underwater vehicle according to claim 1, wherein the control module comprises an environmental sensor, a depth sensor, a temperature sensor, a controller, a main control board, an energy management board, a radio station component, a positioning module, an attitude sensor module, an electronic compass module, and a battery; and the environmental sensor, the depth sensor, the temperature sensor, the controller, the main control board, the energy management board, the radio station component, the positioning module, the attitude sensor module, the electronic compass module, and the battery are all arranged in the control module subassembly.

* * * * *